United States Patent [19]

Gilman

[11] Patent Number: 4,774,623

[45] **Date of Patent: * Sep. 27, 1988**

[54] BISTABLE RELAY CIRCUIT

[76] Inventor: Bernard Gilman, 484 Laurel Rd., Rockville Center, N.Y. 11570

[ * ] Notice: The portion of the term of this patent subsequent to Aug. 11, 2004 has been disclaimed.

[21] Appl. No.: 84,312

[22] Filed: Aug. 10, 1987

Related U.S. Application Data

[63] Continuation-in-part of Ser. No. 866,700, May 27, 1966, Pat. No. 4,686,604.

[51] Int. Cl.[4] ..... H01H 47/00; H01H 47/32; H01H 47/14

[52] U.S. Cl. ..... 361/155; 361/168.1; 361/194

[58] Field of Search ..... 361/155, 167, 168.1, 361/191, 194

[56] References Cited

U.S. PATENT DOCUMENTS 3,264,499 8/1966 Moser et al. ..... 361/168.1

*Primary Examiner*—L. T. Hix

*Assistant Examiner*—David Porterfield

*Attorney, Agent, or Firm*—Erwin S. Teltscher

[57] ABSTRACT

A bistable relay circuit adapted to be operated from a two polarity supply of predetermined voltage, includes a control relay having a coil exhibiting hysterisis, and at least a first single pole, double throw switch, having one pole contact and two non-pole contacts. The control relay coil has a resistance value which is low compared to the resistance value of the first resistor, while a current operatively flowing therethrough is insufficient on its own to energize the control relay. A first resistor is in series with the coil of the control relay. The series combination of the control relay coil and of the first resistor are connected to the power supply. The circuit also includes a second single pole, double throw switch, having one pole contact and two non-pole contacts. A second resistor is connected to the pole contact of the first switch, and to one of the non-pole contacts of the second switch, and a capacitor is connected to the pole of the second switch and to one polarity of the power supply. The remaining non-pole contact of the second switch is connected to the node where the first resistor and control relay coil are connected.

4 Claims, 1 Drawing Sheet

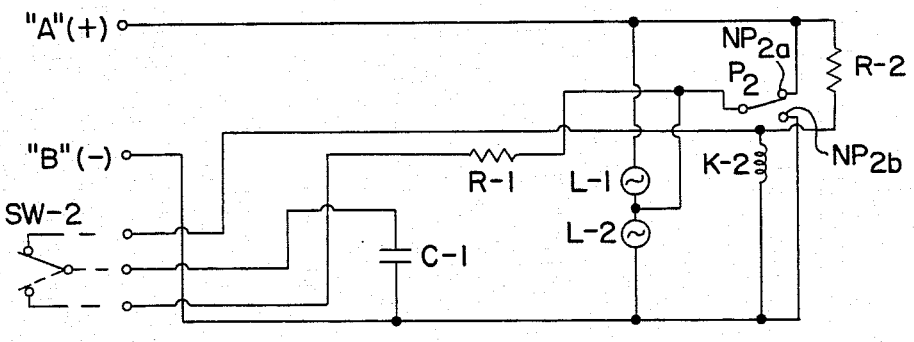
"A"(+)
"B"(-)
SW-2
R-1
C-1
L-1
L-2
K-2
NP2a
P2
R-2
NP2b

BISTABLE RELAY CIRCUIT

This is a continuation-in-part application of appln. Ser. No. 866,700 filed on 5/27/86 since matured into U.S. Pat. No. 4,686,604.

FIELD OF THE INVENTION

The present invention relates to a circuit of achieving what is usually referred to as bistable operation of a relay. In bistable operation, application or removal of power will lock up a relay in a maintained "make" mode and re-application or removal of power will return the relay to a maintained "non-make" mode. As indicated, in bistable operation, power or initiating power or a signal must be either applied twice or removed twice to change the operational modes of the relay from make to non-make, or vice versa.

BACKGROUND OF THE INVENTION

There are presently several methods of achieving bistable operation. Descriptions of their operational methods are as follows:

A- Latching Method:

1- Two relays are mounted adjacently, each having a latching bar that engages with each other. When relay "A" is energized, the latch bar locks up relay "B" in a non-energized mode, and remains that way whether power to relay "B" is maintained or removed. Conversely, when relay "B" is energized, the latch bar locks up relay "A" in a non-energized mode, and remains that way whether power to relay "B" is maintained or removed.

B- Detent Method:

1- In a detent type, a single relay is used with the armature engaged to a split point detent which has a lateral motion to one side or the other with each full excursion of the armature. When the relay is energized, the excursion of the armature moves the detent to one side and it remains in that position. When the power to the relay is released and then re-energized, the excursion of the armature moves the detent to the other side, and it remains in that position. Each time the relay is energized, the detent alternates and holds from one side to the other. By means of a linkage or of an actuating arm or of an eccentric cam, the alternate motion of the detent is used to make or release contacts on the relay.

C- Ratchet and Pawl Method:

In this method, a single relay is used. The armature is involved directly, or through linkage to a pawl which engages a ratchet gear on a shaft. When the relay is energized, the excursion of the armature can be made to either cause a rotation of the shaft, or the rotation of the shaft can occur when the relay is de-energized. By means of alinkage or of an actuating arm or of a cam, the rotation of the ratchet shaft is used to maintain contacts in a make or non-make mode each time the relay is energized or de-energized.

D- Magnetic Method:

1- Magnetic types can be made in single relay or dual relay operation. In the single relay version, a permanent magnet is mounted on the pole piece. The magnetic force of the magnet is sufficient to maintain the armature in an energized position once the relay is energized, but has insufficient magnetic force to energize the relay on its own. In operation, full DC power is supplied to the relay coil to seat the armature. When power is removed, the magnet retains the armature in a seated position, and holds the contacts in a make mode. To release the armature, DC voltage is applied in reverse polarity and at a critical power level that is just sufficient to overcome only the magnetic hold of the magnet, so that the armature releases and the contacts return and hold in a non-make mode.

2- In the magnetic two relay type, two relays face each other with a permanent magnet bar interface having sufficient magnetic force to hold a pivoted common armature for each relay in an energized position on the relay that is energized. the single armature is pivoted between each relay so that when one side of the armature closes on one relay, it will open on the other relay. When sufficient power is applied to one relay coil, the armature will close the remain closed on that relay by the magnetic force of the permanent magnet even when power is removed. When sufficient power is applied to the second relay, the armature will close on the second relay and release the armature of the first relay and the second relay will remian and hold in closed position by the magnetic force of the permanent magnet, even if the power is removed. The rocking motion of the armature due to the closing and opening of each relay is made use of by means of shaft, linkage or operating arm to alternately hold the contacts in either a make or a non-make mode.

E- Electronic Method:

1- The electronic type uses solid state circuitry to place a relay in a make or non-make (release) mode. The circuitry usually consists of integrated circuits (I.C.'s) and/or transistors (PNP's, NPN's, and/or SCR's, etc.) depending on the design. In electronic units, applied power remains on at all times to supply the circuitry, and the make or non-make mode of the relay is controlled and alternated by each opening or each closing of an external control switch, which is applied to the control circuitry of the relay. In the opening switch type, with power applied, the closing of the external switch causes no change in the initial mode of the relay, which is in a non-energized state. Upon opening of the external switch, the relay becomes energized and remains in that state until the external switch is again closed, and then re-opened at which time the relay returns to the non-energized state and remains in that state until the aforegoing cycle of the external switch is repeated.

SUMMARY OF THE INVENTION

The present invention is a unique electrical device employing circutiry that achieves bistable operation (or alternating relays or alternator or other applicable terminology) with mode change with each opening (or by circuitry modification—with each closing) of an external switch without in a preferred embodiment thereof requiring the the use of any I.C.'s and/or any discrete semi-conductor switching device involved in its control circuitry. With each change of mode induced by an external switch to its control circuitry, the relay contacts make or break for purposes of controlling external circuitry or equipment to which the bistable relay is applied. It bistable operation is not achieved mechanically by a ratchet and pawl, or cams, or detents, or latches, or magnets or any other equivalent mechanical devices or methods.

Bistable relays using I.C.'s and/or discrete semi-conductor switching devices, can and have falsely transferred (relay is energized) when an input voltage is initially applied, due to dV/dt problems of certain switching semi-conductors. Such false transfer occurrences, even if rare, can and have caused field an application problems of a minor or serious nature to equipment and functions of equipment or external control circutiry. Bistable relays using I.C.'s and/or discrete semi-conductor switching devices are also very sensitive to transients which can result in catastrophic failure of the I.C.'s or discrete semi-conductor switching devices. Protective circuitry or components can be additionally incorporated within the functional circuitry to limit the catastrophic effects of transients. However, present transient potective devices such as MOV's (metal oxide varistors) can only take a limited number of "hits" after which their protective capabilities are sharply curtailed. Some other suppression devices do not react quickly enough to provide adequate suppression of transients having very sharp or fast rise times.

BRIEF DESCRIPTION OF THE DRAWING

The invention will be better understood with the aid of the drawing, which is a circuit diagram of the preferred embodiment of the present invention.

DESCRIPTION OF THE PREFERRED EMBODIMENTS

The circuitry and method of opperation of the present invention together will now be described as follows: (see the FIGURE)

Terminals "A" and "B" serve for the connection to a supply voltage having alternating (AC) or direct current (DC) values. With AC voltages, a suitable (non-illustrated) rectifier and filter is incorporated into the circuitry, to supply DC to the circuit as the preferential voltage. Relay K-2 is the control relay to be operated in a bistable manner. One set of contacts of relay K-2, acting as a single pole, double throw switch, and having a pole contact $P_2$ and two non-pole contacts $NP_{2a}$ and $NP_{2b}$ is shown which are used in its bistable operation. Other (non-illustrated) set(s) of contacts of control relay K-2 are available for external control of other circuitry or equipment in the manner of which it is to be applied. The operational mode of relay K-2 is controlled by switch SW-2 which is a SPDT switching device that may be mechanical such as push button, toggle, blade or may be solid state switching.

Referring to the FIGURE with voltage initially applied to terminals "A" and "B", and with switch SW-2 in full line position, relay K-2 will remain in a non-energized position. Upon moving switch SW-2 to dotted line position, relay K-2 will remain non-energized. Upon moving switch SW-2 back to full line position, relay K-2 will become energized and remain in this mode. Upon moving switch SW-2 to dotted line position, relay K-2 will remain in energized mode. Upon moving switch SW-2 to full line position, relay K-2 will become de-energized and remain in a non-energized mode. Thereafter, relay K-2 will either go into a non-energized or energized mode with each full excursion of switch SW-2.

Referring to the FIGURE, with voltage initially applied to terminals "A" and "B" and with switch SW-2 in dotted line position, relay K-2 will remain in non-energized position. Upon moving switch SW-2 to full line position, relay K-2 will become energized and remain in this mode. Upon moving switch to dotted line position, relay K-2 will remain in energized mode. Upon moving switch SW-2 to full line position, relay K-2 will become de-energized and remain in a non-energized mode. Thereafter relay K-2 will either go into an energized or non-energized mode with each full excursion of switch SW-2.

The function and description of the circutiry is as follows: switch SW-2 is a switching device having SPDT contacts or any similar device either mechanical or solid state having SPDT contacts. For illustrative purposes, switch SW-2 may be viewed as being mechanical with full line or dotted line positions shown as operational modes. K-2 is functional bistable control relay with one set of its contacts (referred to as $P_2$, $NP_{2a}$, and $NP_{2b}$ used for its control, and the other set(s) of (non-illustrated) contacts for control of external circuitry or equipment in the manner of which it is to be applied. C-1 is a storage capacitor. R-1 is a resistor to limit current in charging and in discharging capacitor C-1. Resistor R-2 is a bias resistor whose value is chosen so as to apply a bias voltage to the coil of control relay K-2 that is insufficient on its own to energize K-2, but is of adequate value to retain K-2 in an energized mode after K-2 is energized by the momentary discharge of the capacitor C-1, as will be described later. The bias voltage also serves to reduce the storage requirements of capacitor C-1.

Upon application of the supply voltage at "A" and "B" and switch SW-2 in full line position, the control relay K-2 is in a non-energized mode. Moving switch to dotted line position, capacitor C-1 is charged to full supply voltage through contacts $P_2$ and $NP_{2a}$ of control relay K-2 with control relay K-2 remaining in the non-energized mode. Upon moving switch SW-2 to full line position, the charge on capacitor C-1 is discharged through the coil of control relay K-2, which energizes K-2, and is kept in an energized mode by the bias voltage, or current flowing through the resistor R-2 and the coil of the control relay K-2. Moving switch SW-2 to dotted line position, any residual charge in capacitor C-1 is fully discharged to ground through contacts $P_2$ and $NP_{2b}$ of relay K-2. Upon moving switch SW-2 to full line position, the inrush of charging current through resistor R-2 to capacitor C-1 causes an additional voltage drop across resistor R-2, so that there is a momentary zero voltage at the coil of control relay K-2, causing K-2 to be de-energized and remain in a de-energized mode. Relay K-2 will either go into an energized or non-energized mode with each full excursion of switch SW-2.

In the FIGURE, two indicator lights L-1 and L-2 give a visual indication of the mode status of control relay K-2.

In a representative, but not limiting embodiment of the present invention the supply voltage ranged from 30–33 Volts, the relay K-2 had a resistance of 800 Ohm, its pull-in range varied from about 16–18 Volts, its release voltage varied within a range of 5–6 Volts, R-2 was 2,400 Ohms, C-1 was 68 microfarads, R-1 was 27 Ohms, and the bias voltage developed across K-2 was 7.5–8.5 Volts.

Other circuitry considerations are possible employing the operational mode of the present invention.

I claim:

1. A bistable relay circuit adapted to be operated from a two polarity supply of a predetermined voltage, comprising in combination, a control relay $K_2$ having a coil, and at least first single pole, double throw switch means $P_2$, having one pole contact and two non-pole contacts, a first resistor $R_2$ in series with said coil of said control relay $K_2$, the series combination of said control relay coil and of said first resistor $R_2$ being connectable to said power supply, said control relay coil $K_2$ having a resistance value which is low compared to the resistance value of said first resistor $R_2$, while a current operatively flowing therethrough $K_2$ is insufficient on its own to energize said control relay, second single pole, double throw switch means $SW_2$, having one pole contact and two non-pole contacts, and a capacitor connected to the pole of said second switch means $SW_2$ whereby (a) upon connection of said circuit to said power supply, and upon said second single pole, double throw switch means $SW_2$ being initially in one of two positions, said control relay $K_2$ is in a non-energized state, (b) upon said double throw switch means $SW_2$ being subsequently in the other of said positions, said capacitor $C_1$ is charged to said voltage, while said control relay $K_2$ remains in said non-energized state, (c) upon said double throw switch means $SW_2$ being subsequently returned to said one position, said capacitor discharges at least partly through said coil of said control relay $K_2$, to charge said control relay to an energized state, and said control relay $K_2$ remains in said energized state by said current continuing to flow through said first resistor $R_2$, (d) upon said single throw switch means $SW_2$ being thereafter in the other position, any residual charge on said capacitor $C_1$ is further discharge through said first switch means $P_2$, while (e) upon said single throw switch means $SW_2$ being subsequently moved to the other position, said capacitor $C_1$ is recharged through said first resistor $R_2$ by a recharging current surge, said recharging current surge being sufficient to cause a momentary voltage drop of sufficient magnitude through said first resistor $R_2$to cause said control relay $K_2$to revert to said non-energized state.

2. The bistable relay circuit as defined in claim 1, further comprising visual indicator means connected to said pole of said first switch means and adapted to be connected to said power supply.

3. The bistable relay circuit as defined in claim 1, wherein said visual indicator means comprise a first indicator light connected to said pole of said first switch means and adapted to be connected to one polarity of said power supply, and a second indicator light connected to said pole of said first switch means, and adapted to be connected to the other polarity of said power supply 4. The bistable relay circuit as defined in claim 1, further comprising a second resistor connected to the pole contact of said first switch means, and to one of said non-pole contacts of said second switch means.

* * * * *